US006918604B2

(12) United States Patent
Liao

(10) Patent No.: US 6,918,604 B2
(45) Date of Patent: Jul. 19, 2005

(54) GOLF-CART UPPER SUPPORT FRAME

(76) Inventor: Gordon Liao, No. 5, Alley 54, Lane 737, Chung Jeng North Road, Yung Kang City, Tainan Hsien (TW)

( * ) Notice: Subject to any disclaimer, the term of this patent is extended or adjusted under 35 U.S.C. 154(b) by 792 days.

(21) Appl. No.: 09/954,118

(22) Filed: Sep. 11, 2001

(65) Prior Publication Data

US 2003/0047651 A1 Mar. 13, 2003

(51) Int. Cl.[7] ..... B62B 1/00

(52) U.S. Cl. ..... 280/47.26; 280/47.24; 280/DIG. 6

(58) Field of Search ..... 280/47.24, 47.26, 280/47.131, 47.17, DIG. 6, 47.34, 651, 652, 639

(56) References Cited

U.S. PATENT DOCUMENTS 2,073,114 A * 3/1937 Martin et al. ..... 280/47.33
2,236,053 A * 3/1941 Caron ..... 280/47.26
3,884,439 A * 5/1975 Jeninga ..... 248/96
5,421,604 A * 6/1995 Wu ..... 280/655
5,464,238 A * 11/1995 Wu ..... 280/42
5,573,211 A * 11/1996 Wu ..... 248/96
5,704,629 A * 1/1998 Wu ..... 280/646
5,725,351 A * 3/1998 Guibert et al. ..... 280/646
6,000,712 A * 12/1999 Wu ..... 280/639
6,019,324 A * 2/2000 Wu ..... 248/96
6,283,418 B1 * 9/2001 Kerspilo et al. ..... 248/96
6,364,327 B1 * 4/2002 Liao ..... 280/40
6,402,097 B1 * 6/2002 Wu ..... 248/98
6,439,585 B1 * 8/2002 Tan ..... 280/47.26
6,513,816 B1 * 2/2003 Kijima ..... 280/47.26
6,598,889 B1 * 7/2003 Su ..... 280/47.26

* cited by examiner

*Primary Examiner*—Christopher P. Ellis
*Assistant Examiner*—Kelly E Campbell
(74) *Attorney, Agent, or Firm*—Bacon & Thomas PLLC

(57) ABSTRACT

A golf-cart upper support frame includes an upper and a lower cap, two slide blocks, two movable wings and a band unit. The two slide blocks are movably combined the upper and the lower cap, having respectively a shaft base for a shaft to insert and also in each wing under the shaft base. Each wing has a concave surface in a front side for receiving a club bag. The band unit is combined with the two wings to bind a club bag resting on the two wings adjustable in their locations by the slide blocks so that club bags of various sizes may be carried resting on the upper support frame adjustable in its size. So a club bag carried by the golf cart with the upper support frame might not sway around, even if the golf cart should run on a non-flat rough ground.

2 Claims, 15 Drawing Sheets

GOLF-CART UPPER SUPPORT FRAME

BACKGROUND OF THE INVENTION

This invention related to a golf-cart upper support frame, particularly to one possible to support various specifications and shapes of club bags stably enough not to let club bags move around therein.

A common known conventional golf-cart upper support frame 2 has a structure shown in FIGS. 1 and 2, includes mainly a concave surface 20 and a band 21 respectively bound at two sides of the concave surface 20. There is a proper distance d (60 mm or so) between the concave surface 20 and an elongate tube 10 of a golf cart 1, letting the heads of golf clubs in a club bag 3 not collide with the elongate tube 10 when the club bag 3 rests on the upper support frame 2, as shown in FIG. 3. However, the concave surface 20 of the known conventional golf-cart upper support frame has a definite shape and size so the size of a club bag possible to be received by the concave surface is limited, so club bags of comparative larger or smaller size, non-circular, or club bags 3A supported by a tripod are difficult to be supported stably by the concave surface 20. Above all, the club bag supported by a tripod is the least suitable for the concave surface 20, as the rod 30A of the tripod have to contact the concave surface 20 and bound by the two bands 21 on the club bag 3A to cause the elongate tube 30A of the club bag 3A pressed. Then the club bag 3A contacts the concave surface with only points, resulting in inferior effect of stabilization of the club bag 3A. In addition, the rod 30A of the tripod may be pressed to break.

Another known conventional golf-cart upper support frame 4 shown in FIG. 6 includes two side wings 41 pivotally connected to a concave surface 40 and adjustable in their angle so that the concave surface together with the two adjustable wings 41 may receive club bags of various sizes, but can not support specially shaped club bags. Moreover, the two adjustable wings 41 are not able to be stabilized after adjusted in their angles, so the club bag may still vibrate when the golf cart moves on non-flat rough ground.

SUMMARY OF THE INVENTION

This invention has been devised to offer a golf-cart upper support frame possible to support club bags of various sizes stably, not swaying around even the golf cart runs on rough ground.

BRIEF DESCRIPTION OF DRAWINGS

This invention will be better understood by referring to the accompanying drawings, wherein.

BRIEF DESCRIPTION OF THE PREFERRED EMBODIMENTS

Figure 2:
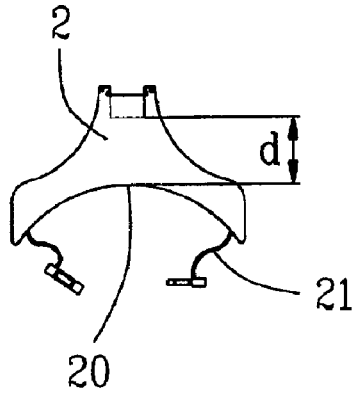
FIG. 2 (PRIOR ART)
FIG. 2 is an upper view of an upper support frame of the known conventional golf cart.
Figure 1:
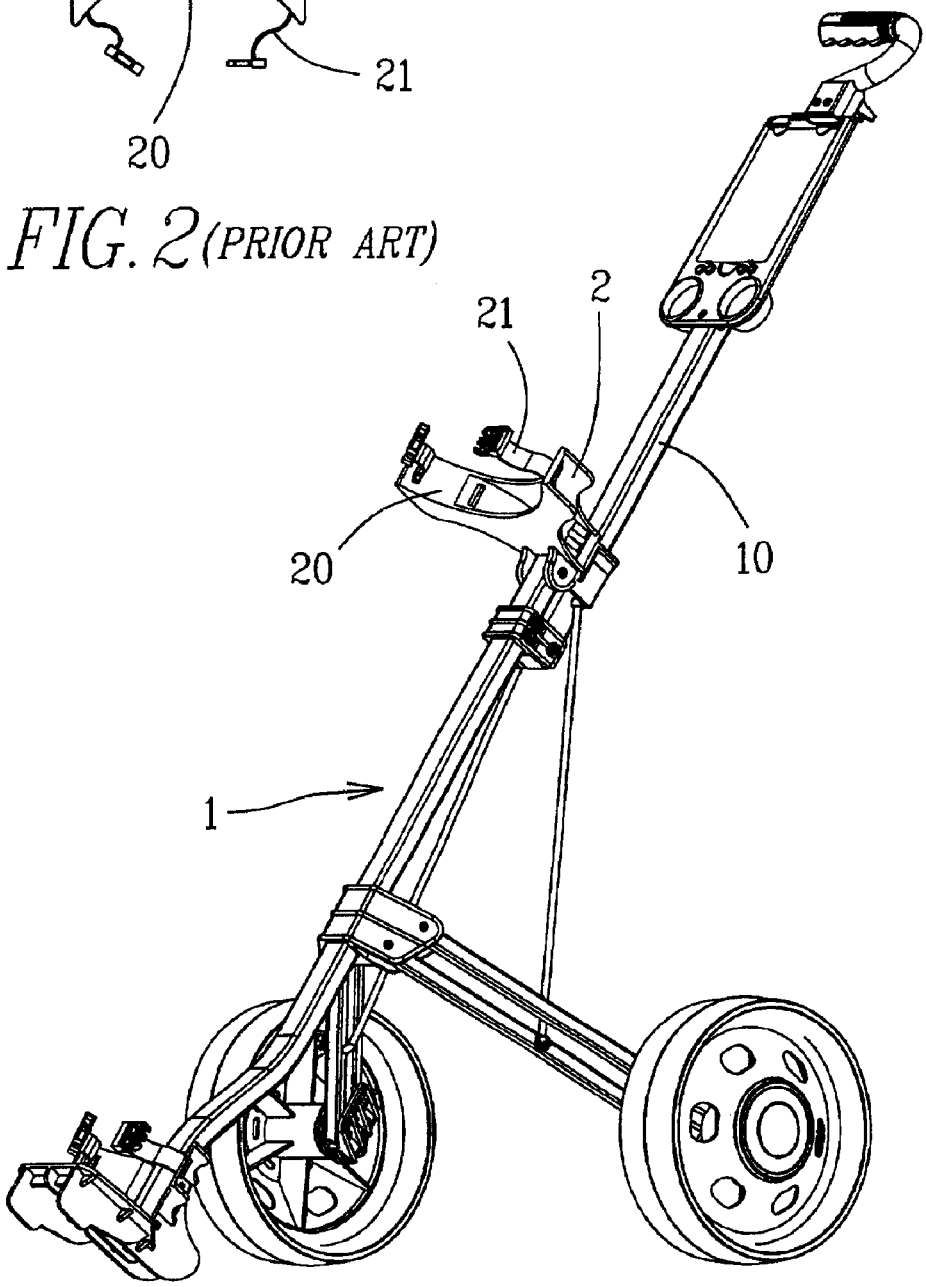
FIG. 1 (PRIOR ART)
FIG. 1 is a perspective view of a known conventional golf cart.
Figure 3:
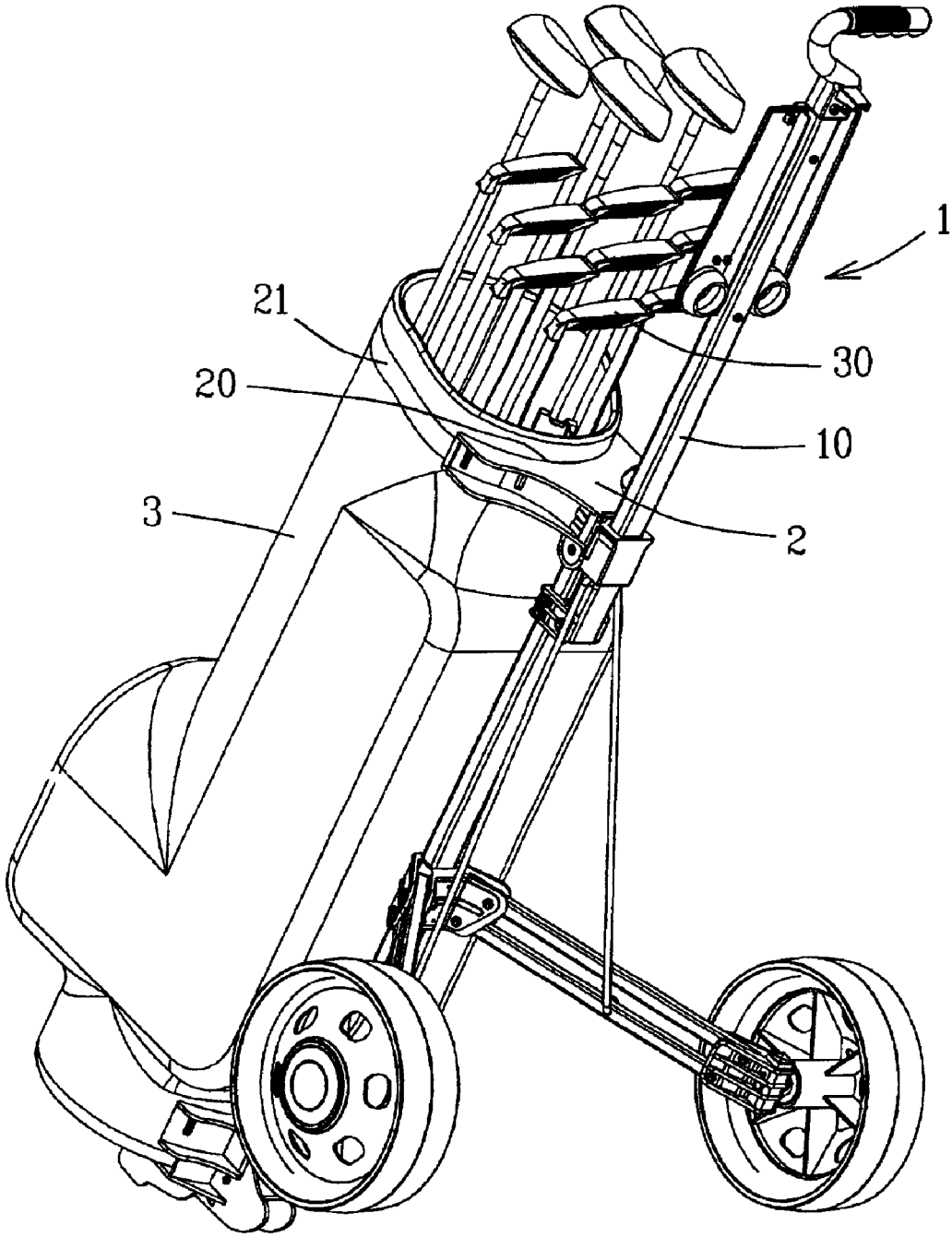
FIG. 3 (PRIOR ART)
FIG. 3 is a perspective view of the known conventional golf cart carrying a club bag.
Figure 4:
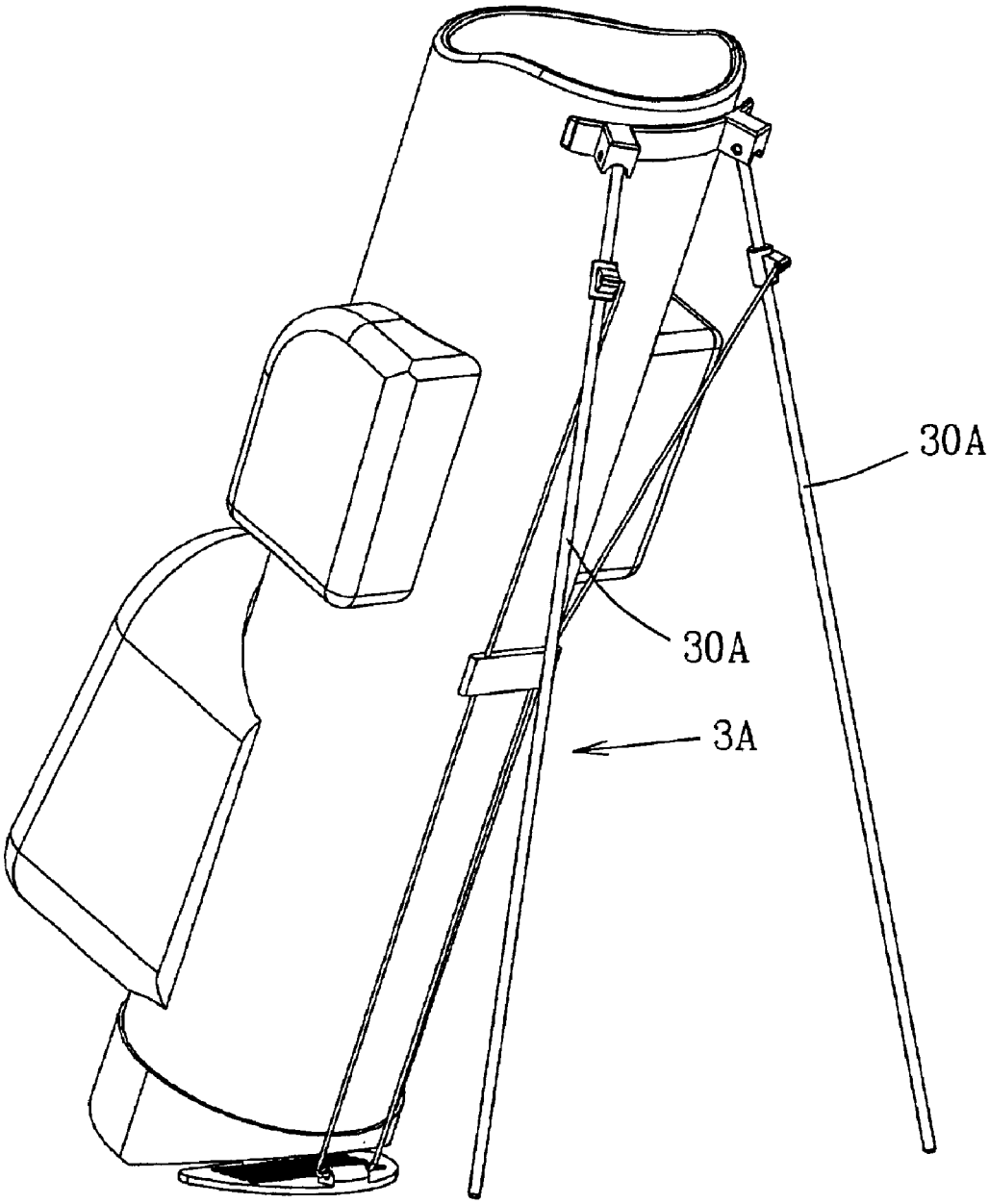
FIG. 4 (PRIOR ART)
FIG. 4 is a perspective view of a club bag with a tripod.
Figure 5:
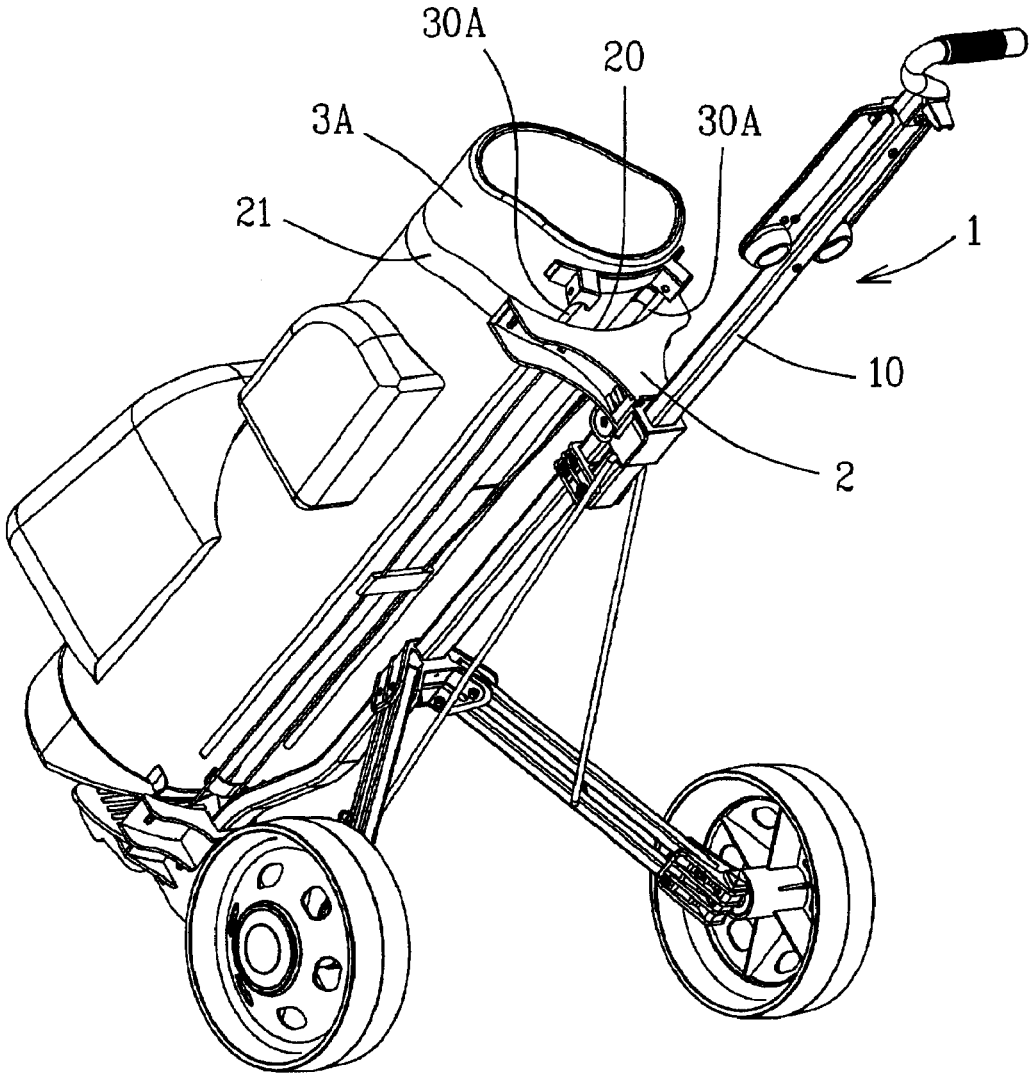
FIG. 5 (PRIOR ART)
FIG. 5 is a perspective view of the known conventional golf cart carrying the club bag with a tripod shown in FIG. 4.
Figure 6:
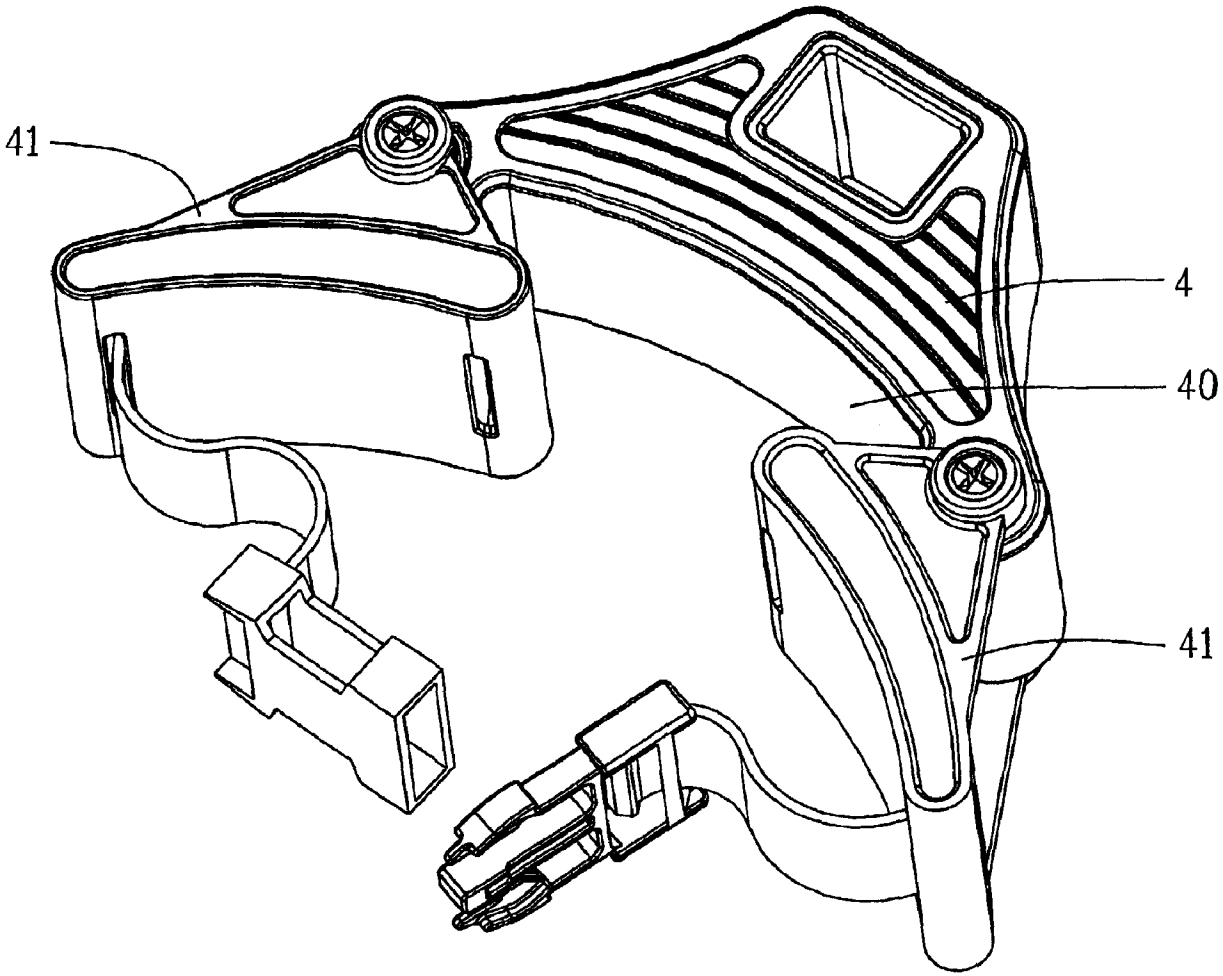
FIG. 6 (PRIOR ART)
FIG. 6 is another known conventional golf-cart upper support frame
Figure 7:
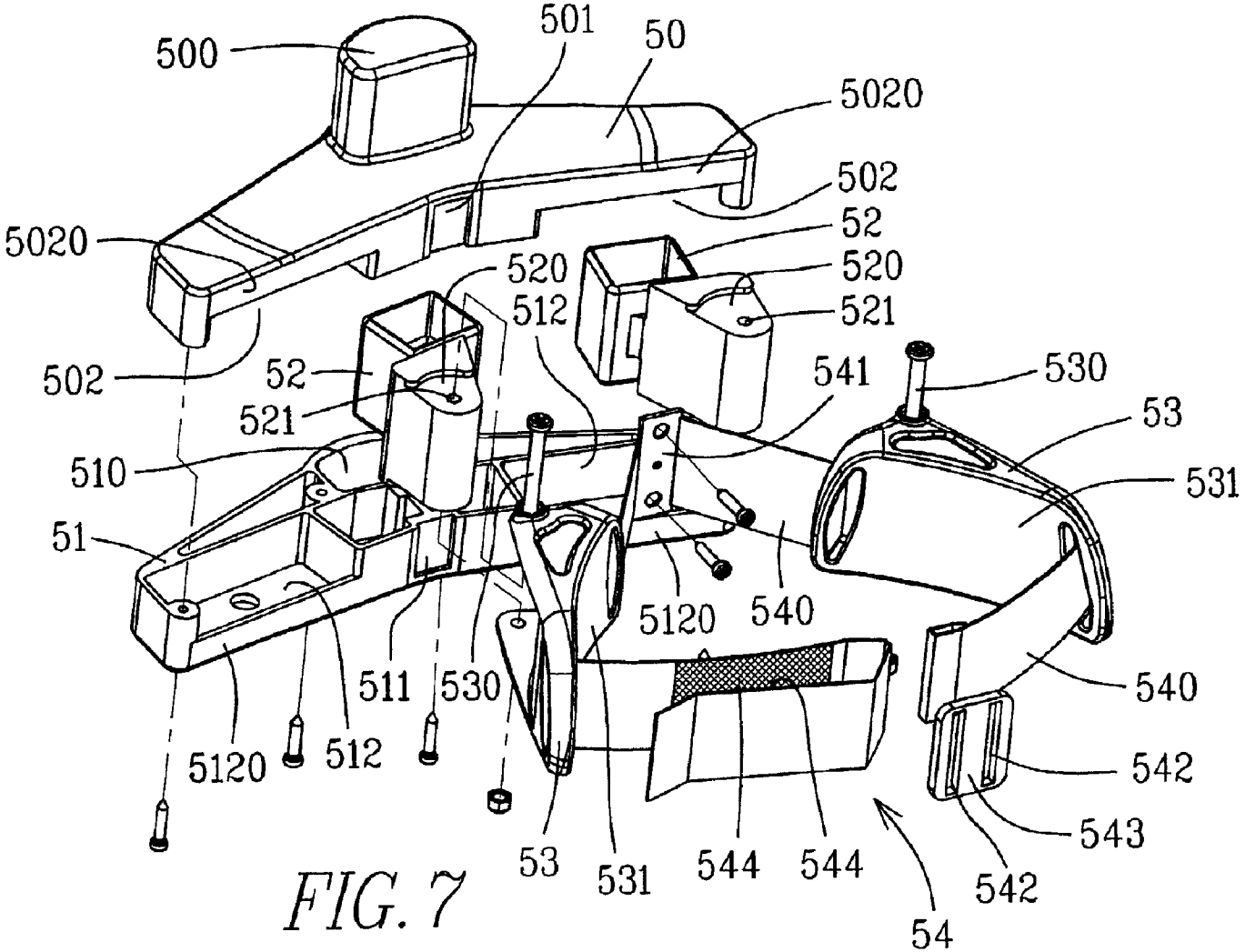
FIG. 7 is an exploded perspective view of a golf-cart upper support frame in the present invention.
Figure 8:
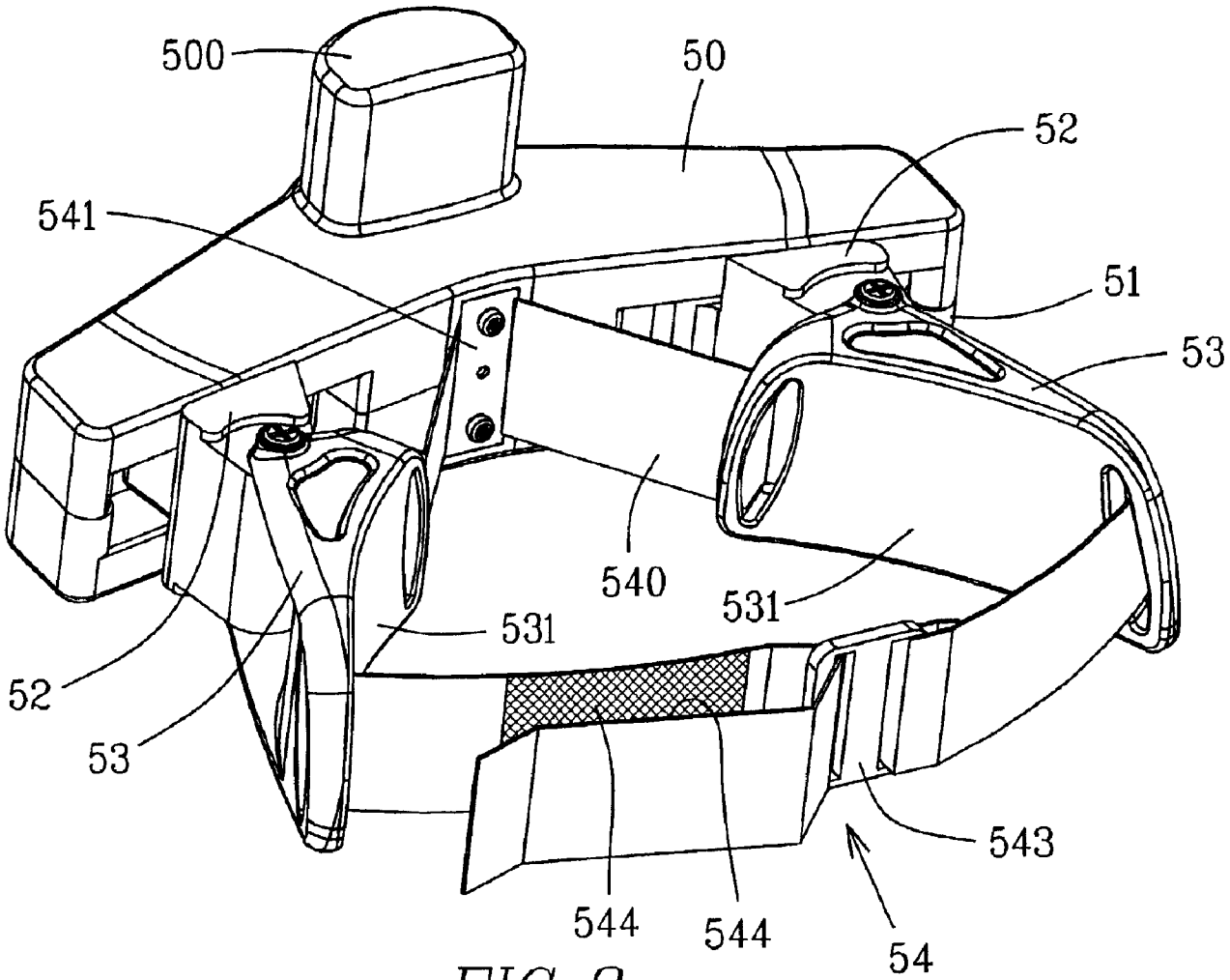
FIG. 8 is a perspective view of the golf-cart upper support frame in the present invention.

A preferred embodiment of a golf-cart upper support frame 5 in the present invention, as shown in FIGS. 7 and 8, includes an upper cap 50, a lower cap 51, two slide blocks 52 and two movable wings 53 as main components combined together.

The upper cap 50 has a sleeve 500 formed on a rear center of an upper surface, a vertical recessed surface 501 formed in the center a front vertical side, a slide recess 502 respectively formed in two sides of the recessed surface 501 in the bottom facing downward.

The lower cap 51 is located under the upper cap 50, having a corresponding structure of sleeve 510, a vertical recessed surface 511 and two glide recesses 512.

Figure 9:
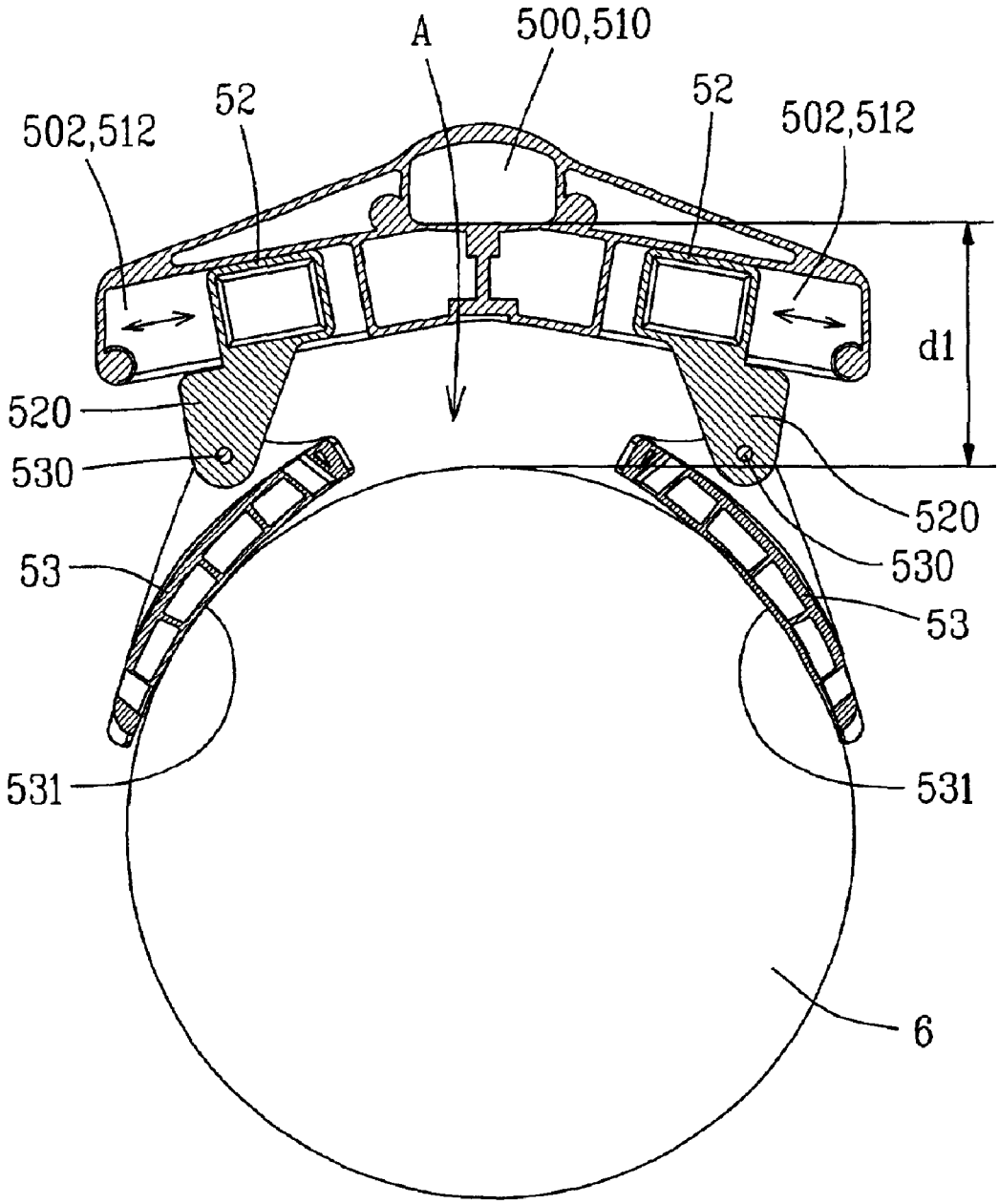
FIG. 9 is an upper cross-sectional view of the golf-cart upper support frame in the present invention, with a club bag carried on the golf cart.

Two slide blocks 52 respectively and movably fit in the two pairs of slide recesses 502 and 512 and stopped by side walls defined by the recesses 5020 and 5020 and unable to slide out of them, as shown in FIG. 9. Further, each slide block 52 has a shaft base 520 formed to extend forward and having a vertical shaft hole 521 for connecting a movable wing 53 with a shaft 530.

The two movable wings 53 are respectively connected to the shaft base 520 of the slide block 52 with the shaft 530 inserting in the shaft hole 521, as shown in FIGS. 8 and 9, permitting the two movable wings 53 move to adjust their angles so that an inner concave surface 531 of the two movable wings 53 to receive the convex circumference 531 of a club bag. Further, a band unit 54 is combined with the two movable wings 53 having its center section fixed on the front center vertical surfaces 501 and 511 of the upper and the lower cap 50, and 51 with a fixer 541 and extend respectively along behind the two wings 53 to pass through a band slot in the front end of each movable wing 53 for binding a club bag stably, not permitting the club bag sway or move around therein even if the golf car should run on rough ground. The band unit 54 has a buckle 543 with two vertical slots 542 for one end of the band 540 to pass through one of the two slots 542 and bend back as shown in FIG. 8. The bending sections of the band 540 are each attached with a Velcro band 544 to adhere together to bind a club bag.

Figure 10:
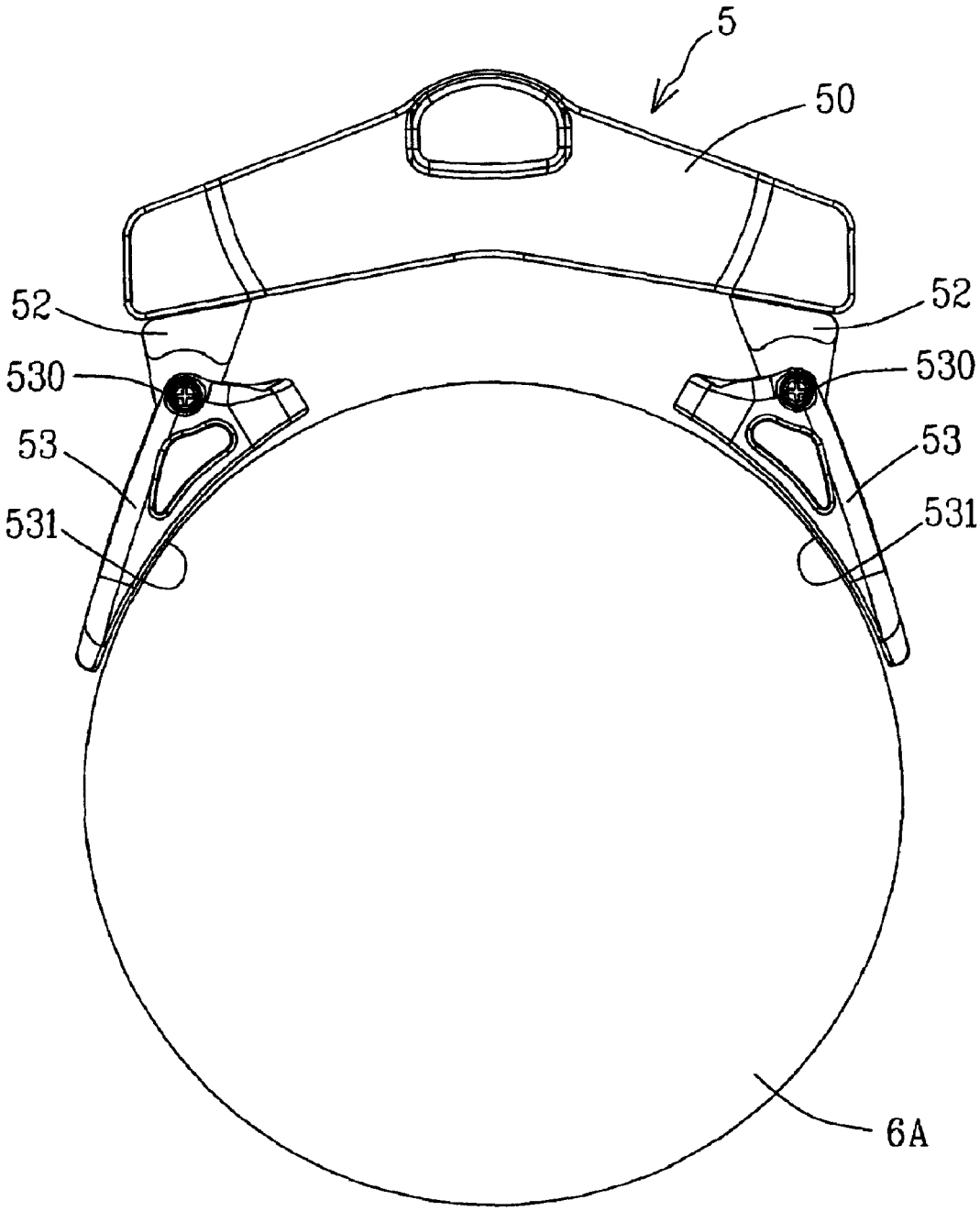
FIG. 10 is an upper view of the golf-cart upper support frame receiving a club bag of a largest size.
Figure 11:
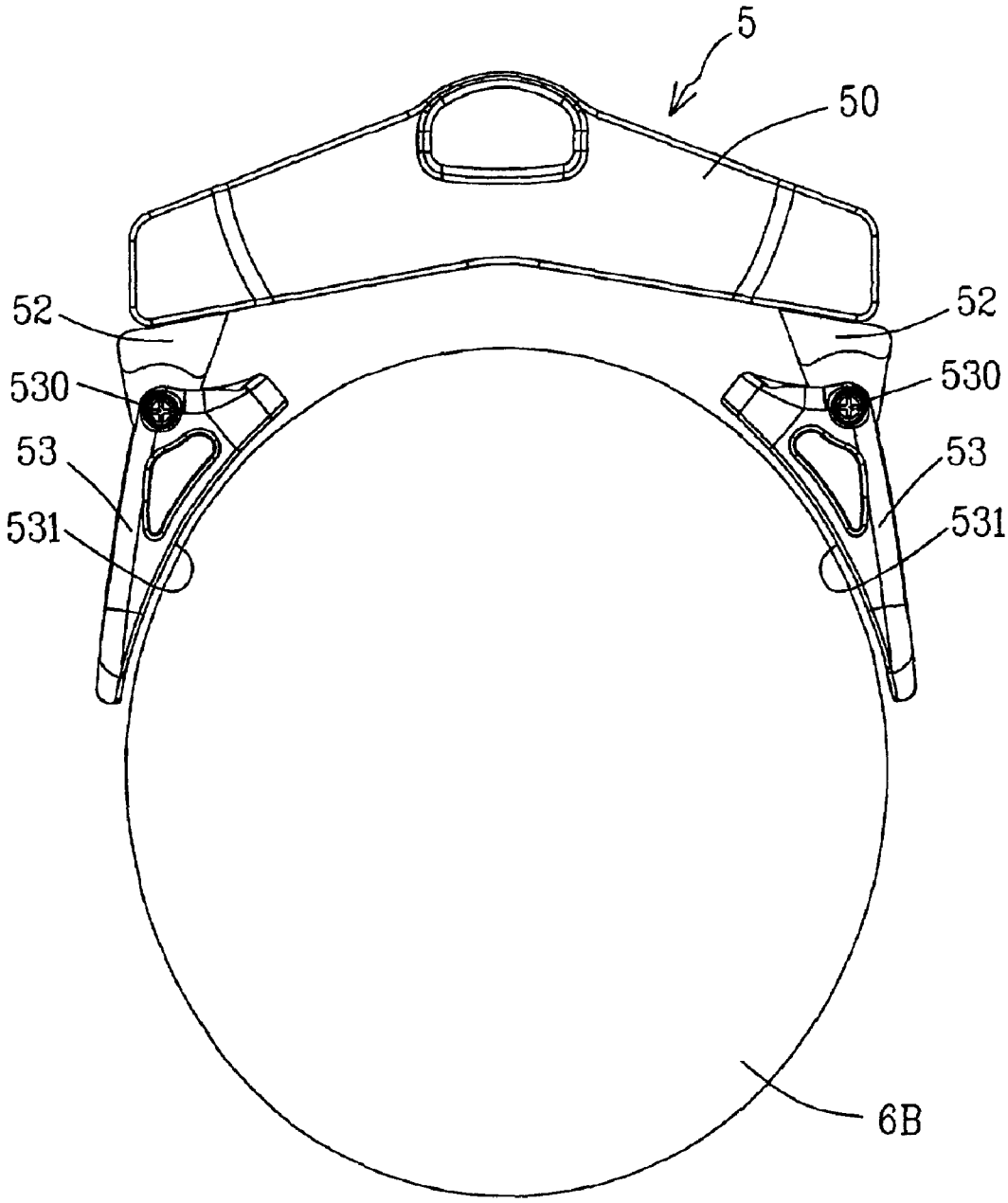
FIG. 11 is an upper view of the golf-cart upper support frame receiving a club bag of a medium size.
Figure 12:
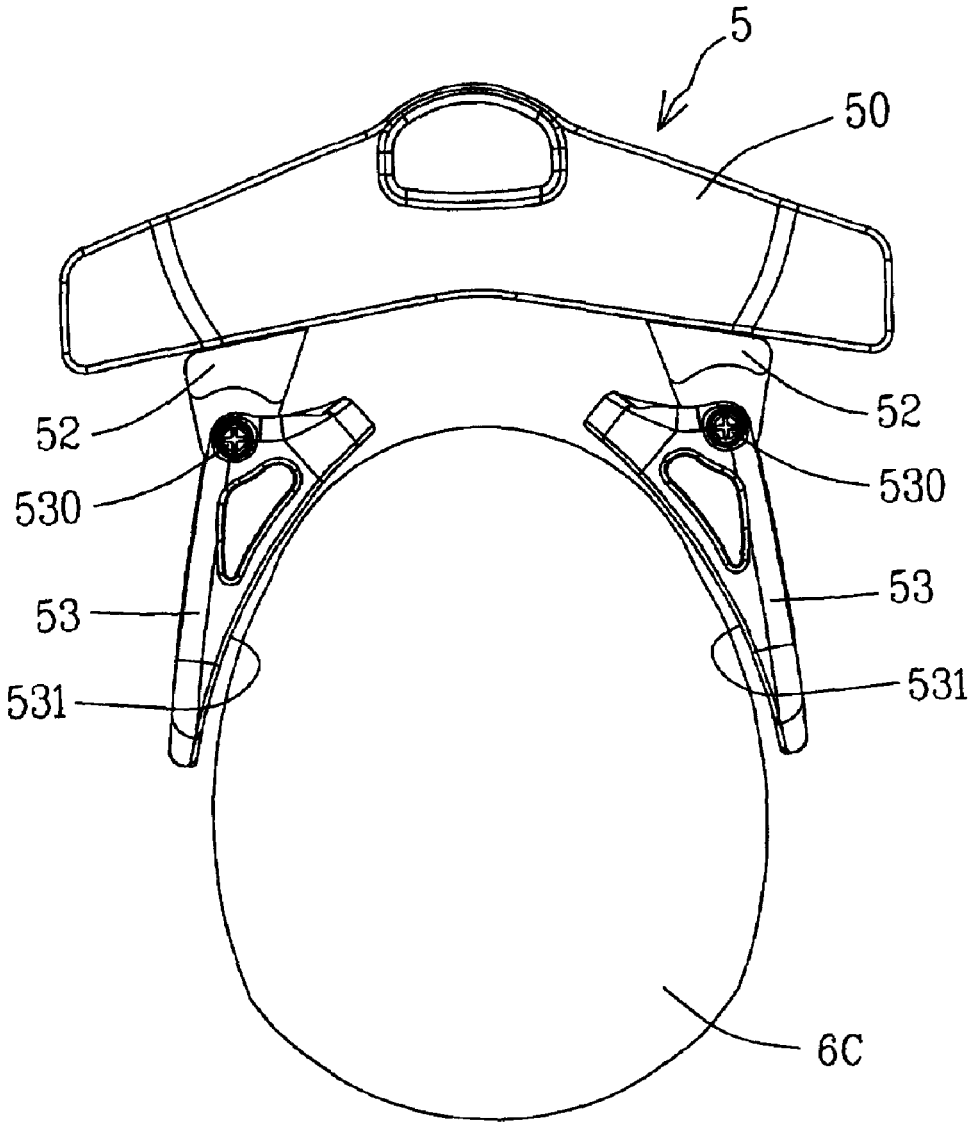
FIG. 12 is an upper view of the golf-cart upper support frame receiving a club bag of a smallest size.
Figure 13:
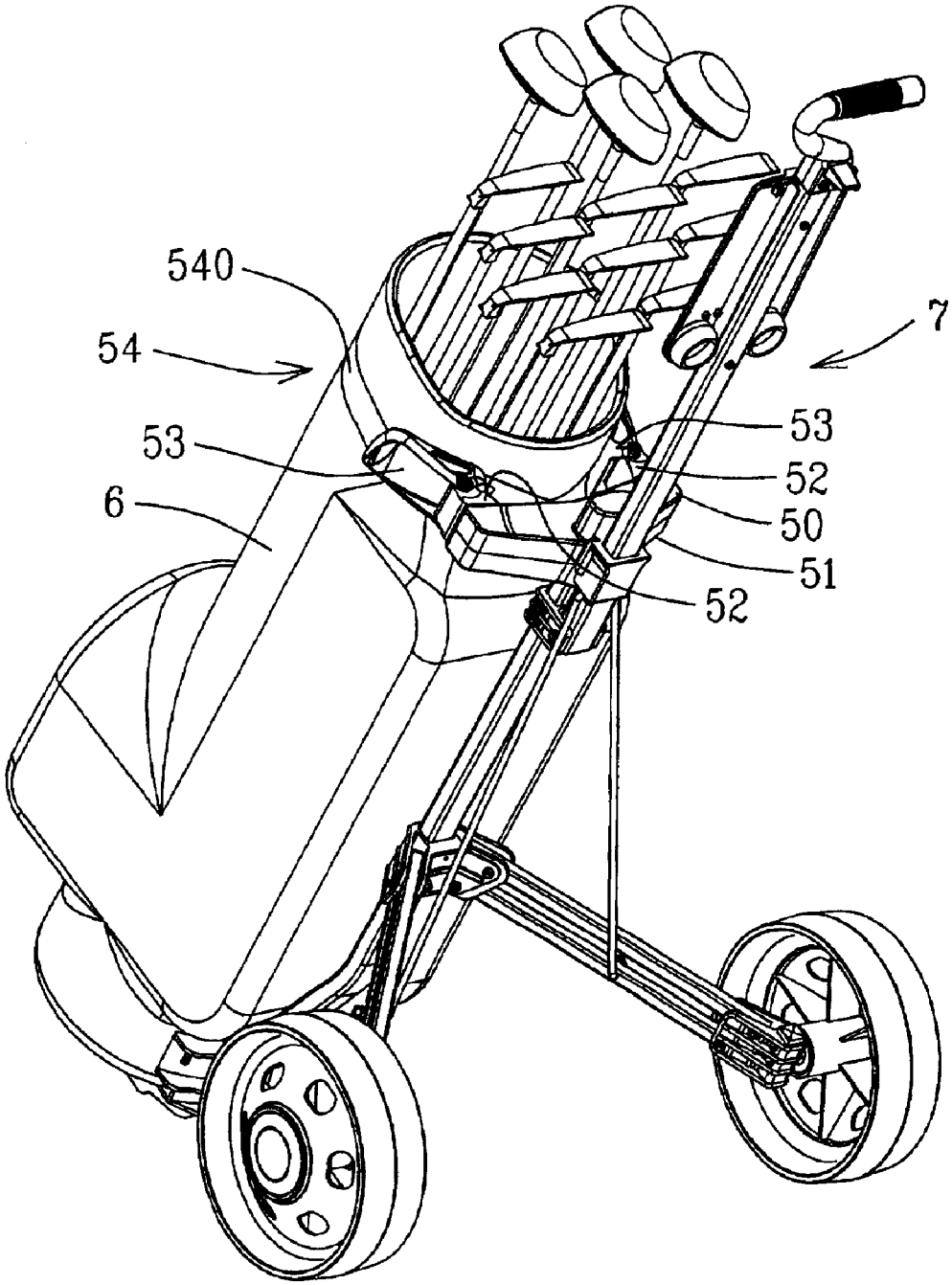
FIG. 13 is a perspective view of the golf-cart with the upper support frame in the present invention, carrying a club bag.
Figure 14:
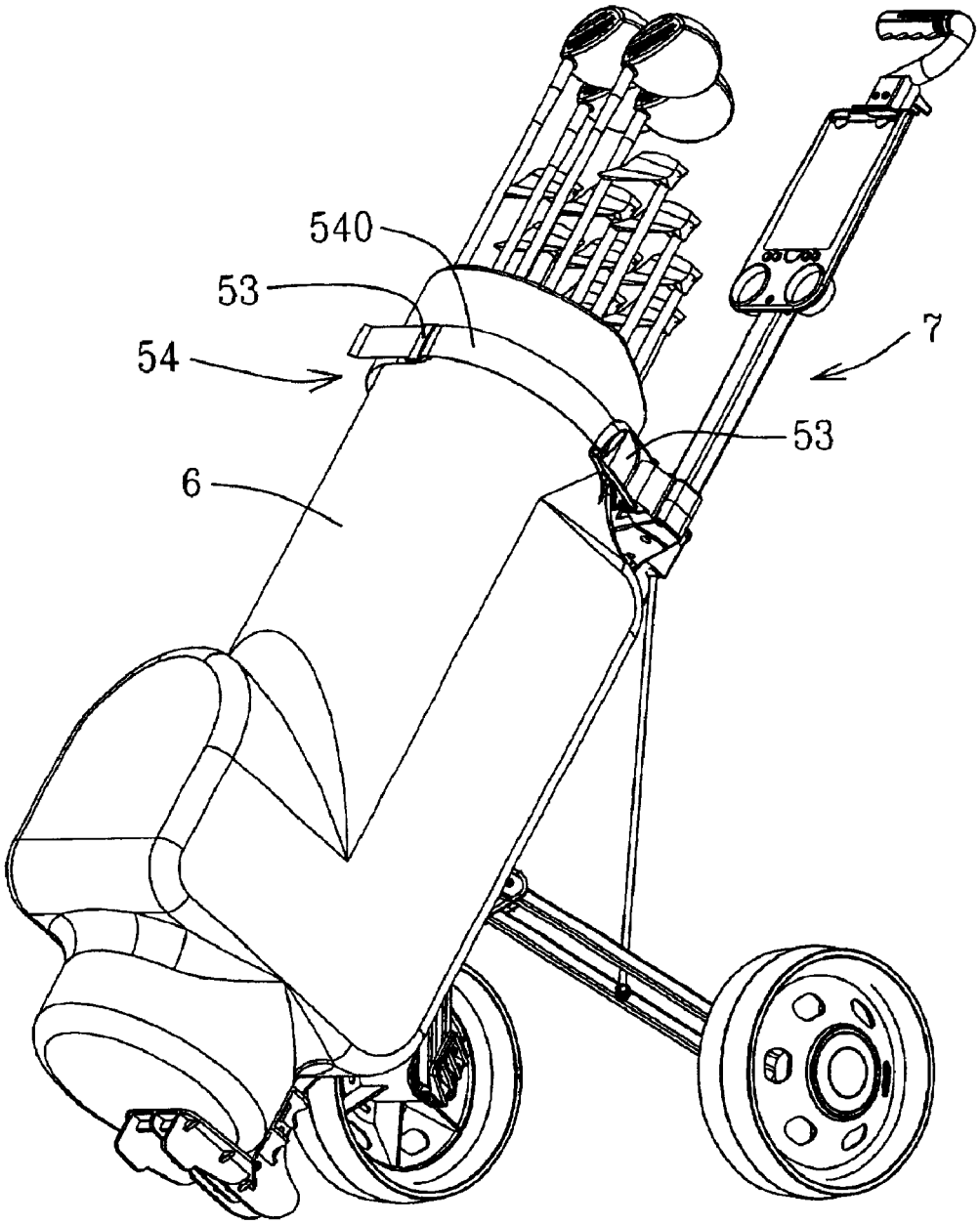
FIG. 14 is another perspective view of the golf-cart upper support frame in the resent invention, carrying a club bag.
Figure 15:
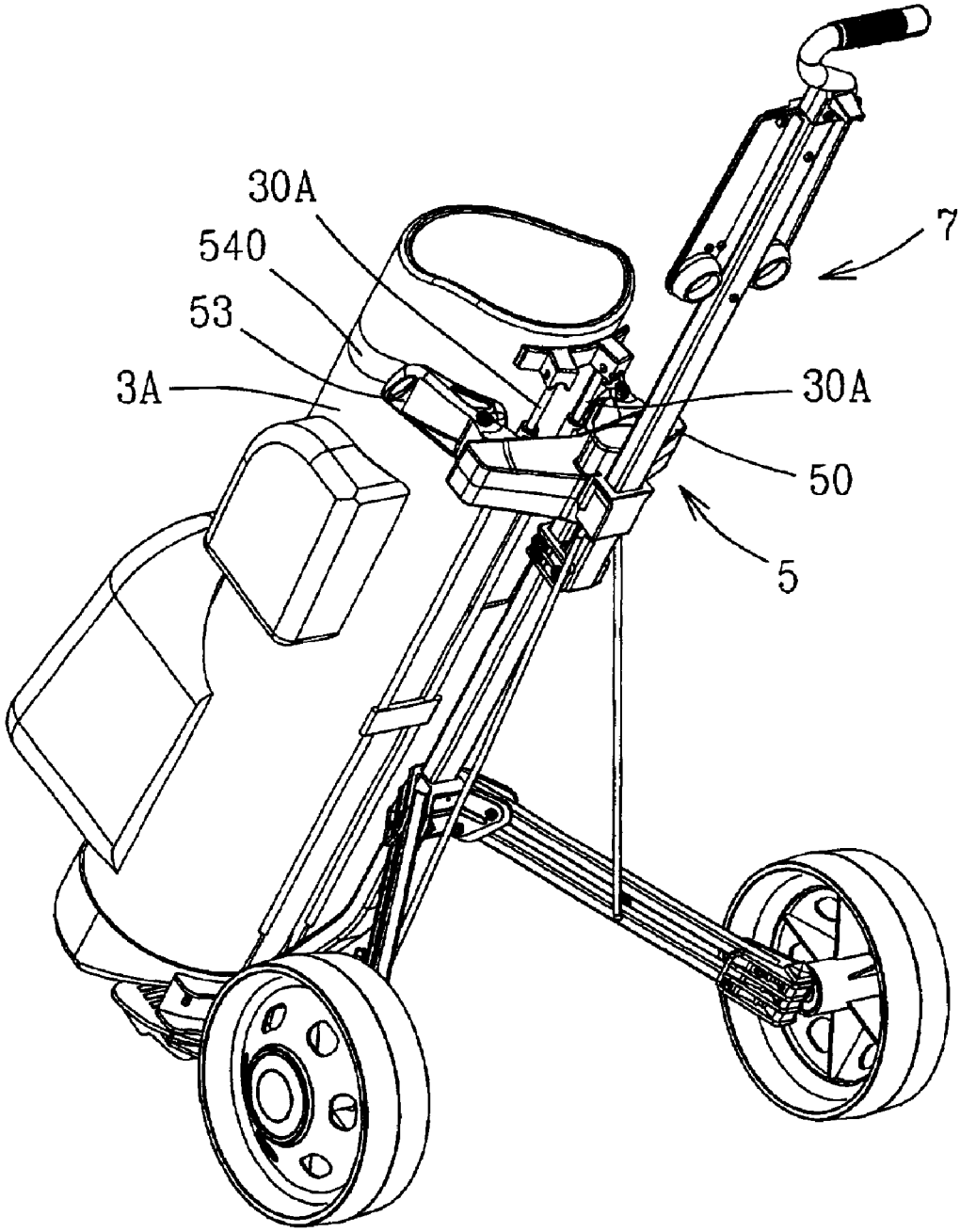
FIG. 15 is a perspective view of the golf-cart upper support frame in the present invention, carrying a club bag with a tripod; and, FIG. 16 is an upper view of the gold-cart upper support frame in the present invention, carrying a club bag with a tripod.
Figure 16:
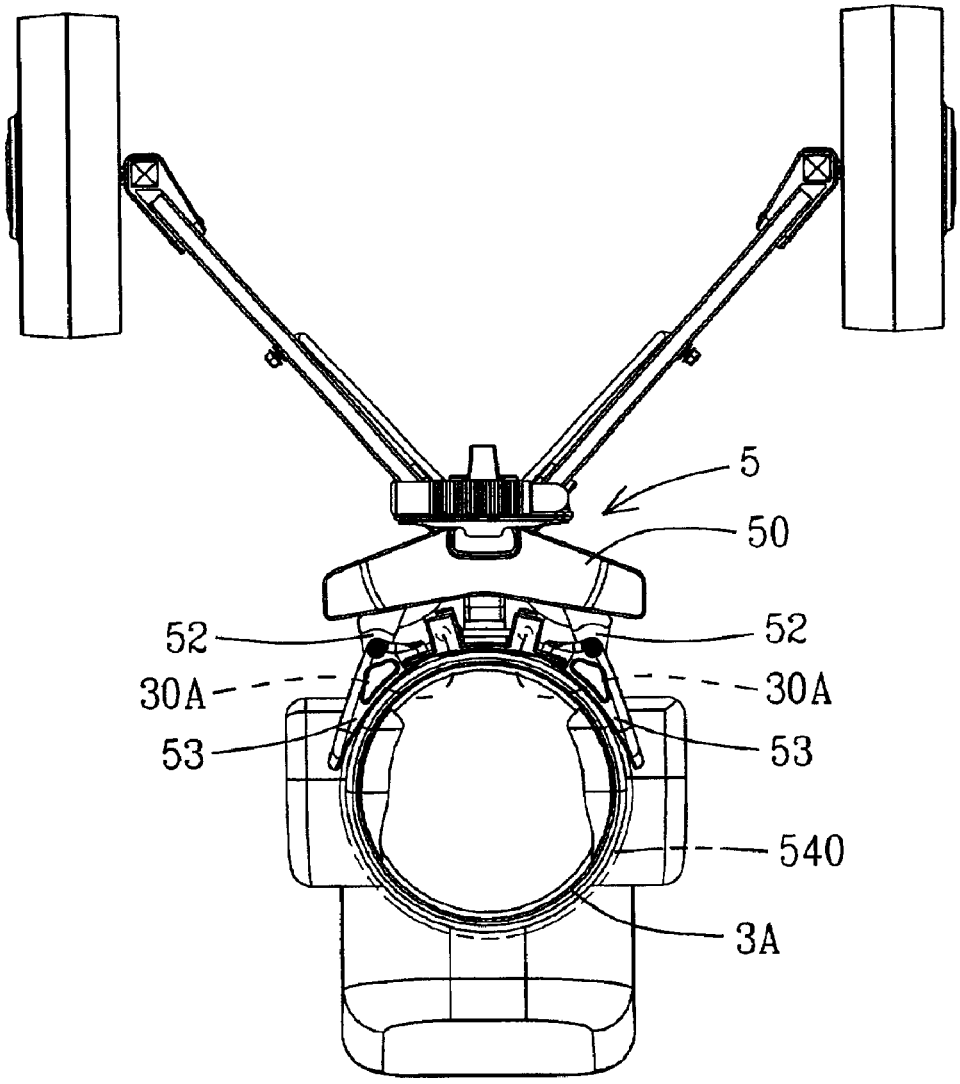

The upper support frame will become the shape as shown in FIG. 8 after it is assembled together, with the slide blocks 52 adjustable according to the size of a club bag, as shown in FIG. 9. Therefore, club bags 6A, 6B and 6C can rest against the two wings 53 as shown in FIGS. 10, 11 and 12 and then are bound around by the band unit 54 tightly and stably, as shown in FIGS. 13 and 14. The band 540 is kept tight and stable owing to its center section fixed firmly with the fixer 541 on the vertical front recessed surfaces 501 and 510, so the band 540 tightly and stably binds the club bag 6, not letting the club bag 6 sway around even if the golf cart should run on non-flat rough ground. At the same time, the two slide blocks 52 and the two movable wings 53 are also tightly and stably bound by the band 540 to keep a club bag 6 in its place immovable. In addition, the two movable wings 53 are combined with the two slide blocks 52 with the shafts 530, the distance d1 between a club bag 6 and the sleeve 500 becomes 75 mm or so, longer than that of the conventional one, as shown in FIG. 9. Then the heads of golf clubs put in the club bag can be prevented from colliding with the golf cart 7.

Furthermore, after the two movable wings 53 receives a club bag 6, a hollow space A is formed between the upper and the lower cap 50 and 51 and the club bag 6 as shown in FIG. 9, so even a club bag 3A with a tripod with a rod 30A will not be pressed by located in the hollow space A.

While the preferred embodiment of the invention has been described above, it will be recognized and understood that various modifications may be made therein and the appended claims are intended to cover all such modifications that may fall within the spirit and scope of the invention.

I claim:

1. A golf-cart upper support frame comprising:

an upper cap and a lower cap, a left slide recess and a right slide recess formed, respectively, in a bottom surface of said upper cap and a top surface of said lower cap, a slide block movably fitted in each of said two slide recesses, and a shaft base respectively fixed with a front side of each said slide block and having a center vertical shaft hole;

two movable wings respectively combined with said two shaft base with a shaft fitting in said shaft hole of said shaft base and a shaft hole of each said movable wings located under said shaft base, said two movable wings each respectively having a concave surface formed in a front side for receiving a club bag, a band unit having a band and a buckle, said band having its center section fixed on a vertical recess surface of said upper cap and of said lower cap and extending forwardly along a rear side of each said movable wing for tying tightly around a club bag; and said two slide blocks together with said two movable wings being movable right and left to adjust locations for adapting to a size of a club bag, and said band unit tightly and stably binding around an outer surface of the club bag to render same immovable.

2. The golf-cart upper support frame of claim 1, further including a fixer and said band is fixed tightly on a center vertical surface of said upper and said lower cap by said fixer.

* * * * *